US011155441B2

(12) United States Patent
Kajita

(10) Patent No.: US 11,155,441 B2
(45) Date of Patent: Oct. 26, 2021

(54) BUFFER CAP FOR ELEVATOR

(71) Applicant: Mitsubishi Electric Corporation, Tokyo (JP)

(72) Inventor: Akinari Kajita, Inazawa (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 210 days.

(21) Appl. No.: 16/482,257

(22) PCT Filed: Mar. 30, 2017

(86) PCT No.: PCT/JP2017/013364
§ 371 (c)(1),
(2) Date: Jul. 31, 2019

(87) PCT Pub. No.: WO2018/179271
PCT Pub. Date: Oct. 4, 2018

(65) Prior Publication Data

US 2021/0276828 A1 Sep. 9, 2021

(51) Int. Cl.
*B66B 5/28* (2006.01)
*B66B 5/00* (2006.01)

(52) U.S. Cl.
CPC ..... *B66B 5/282* (2013.01); *B66B 5/0056* (2013.01); *B66B 5/288* (2013.01)

(58) Field of Classification Search
CPC ..... B66B 5/0056; B66B 5/282; B66B 5/288
See application file for complete search history.

(56) References Cited

FOREIGN PATENT DOCUMENTS

| | | | | | |
|---|---|---|---|---|---|
| CN | 103693526 | A | | 4/2014 | |
| CN | 106629335 | A | * | 5/2017 | |
| CN | 111071900 | A | * | 4/2020 | |
| CN | 112551295 | A | * | 3/2021 | |
| DE | 202014105635 | U1 | * | 2/2016 | ..... B66B 5/0056 |
| DE | 102017004719 | A1 | * | 11/2018 | ..... B66B 5/0056 |
| DE | 202017106151 | U1 | * | 1/2019 | ..... B66B 5/0056 |
| EP | 1598301 | A1 | * | 11/2005 | ..... B66B 5/282 |
| FI | 119808 | B | * | 3/2009 | |
| JP | 2001-151432 | A | | 6/2001 | |

(Continued)

OTHER PUBLICATIONS

Office Action dated Dec. 9, 2020, in corresponding Korean patent Application No. 10-2019-7026448, 7 pages.

(Continued)

*Primary Examiner* — Minh Truong
(74) *Attorney, Agent, or Firm* — Xsensus LLP

(57) ABSTRACT

According to one embodiment of the present invention, there is provided a buffer cap for an elevator to be placed on an upper surface of a buffer provided below a counterweight for an elevator so as to be opposed to a lower surface of the counterweight, which is configured to restrict lowering of the counterweight, the buffer cap including: a support column; an upper plate provided to an upper end of the support column; and a lower plate provided to a lower end of the support column, wherein the support column is formed of flat plates, and each of the upper plate and the lower plate is formed of a flat plate, and wherein the flat plates for forming the support column, and the flat plates for the support column and the upper plate or the lower plate are fittable and disassemblable.

2 Claims, 7 Drawing Sheets

(56) References Cited

FOREIGN PATENT DOCUMENTS

| | | | | | |
|---|---|---|---|---|---|
| JP | 2003155176 | A | * | 5/2003 | ..... B66B 5/288 |
| JP | 2007-119199 | A | | 5/2007 | |
| JP | 2007-254103 | A | | 10/2007 | |
| JP | 2009-286582 | A | | 12/2009 | |
| JP | 2013-044339 | A | | 3/2013 | |
| JP | 2014-5133 | A | | 1/2014 | |
| JP | 2016-196338 | A | | 11/2016 | |
| KR | 200382890 | Y1 | * | 4/2005 | |

OTHER PUBLICATIONS

Office Action dated Nov. 25, 2020, in corresponding Indian patent Application No. 201947035916, 5 pages.
International Search Report and Written Opinion dated Jul. 4, 2017 for PCT/JP2017/013364 filed on Mar. 30, 2017, 8 pages including English Translation of the International Search Report.

* cited by examiner

BUFFER CAP FOR ELEVATOR

CROSS-REFERENCE TO RELATED APPLICATION

The present application is based on PCT filing PCT/JP2017/013364, filed Mar. 30, 2017, the entire contents of which are incorporated herein by reference.

TECHNICAL FIELD

The present invention relates to a buffer cap to be placed on top of a buffer to ensure a safety space for a worker at time of maintenance inspection for an elevator.

BACKGROUND ART

When a car s erroneously raised under a state in which a maintenance worker is present on top of the car, there is a risk in that the maintenance worker may collide against a ceiling. When the car is erroneously lowered under a state in which the maintenance worker is present in a pit, there is a risk in that the maintenance worker may collide against the car. Thus, countermeasures to prevent the collisions described above have been taken. For example, in Patent Literature 1, there is described a configuration in which lowering prevention means is mounted as a buffer cap onto top of a spring buffer so as to be placed thereon to thereby inhibit lowering of a counterweight or a car beyond a predetermined position (Patent Literature 1).

CITATION LIST

Patent Literature

[PTL 1] JP 2007-119199 A.

SUMMARY OF INVENTION

Technical Problem

The above-mentioned buffer cap for an elevator includes a lower-surface abutment portion, an upper-surface abutment portion, and a raised portion. The lower-surface abutment portion is mounted onto the top of the spring buffer so as to be placed thereon. When the counterweight or the car is lowered beyond the predetermined position, a load thereof acts on the upper-surface abutment portion.

The raised portion is configured to support the lower-surface abutment portion and the upper-surface abutment portion at a predetermined interval therebetween in a vertical direction. In the buffer cap, the lower-surface abutment portion, the upper-surface abutment portion, and the raised portion are formed integrally to have a shape for use by, for example, welding. Therefore, a general shape thereof is increased to increase a size and a weight. Thus, the buffer cap is inconvenient to convey. Further, when the buffer cap is not in use, the buffer cap is stored in the pit. However, a large space is required for the storage. Thus, there arises a problem in that a narrow pit space is reduced due to the storage.

The present invention has been made to solve the problems described above, and has an object to provide a buffer cap, which is formed of a plurality of flat plates, each having fitting means fittable to each other or disassemblable from each other, to facilitate conveyance of the buffer cap by a worker and enable storage in a compact space.

Solution to Problem

According to one embodiment of the present invention, there is provided a buffer cap for an elevator to be placed on an upper surface of a buffer provided below a counterweight for an elevator so as to be opposed to a lower surface of the counterweight, which is configured to restrict lowering of the counterweight, the buffer cap including: a support column; an upper plate provided to an upper end of the support column; and a lower plate provided to a lower end of the support column, wherein the support column is formed of flat plates, and each of the upper plate and the lower plate is formed of a flat plate, and wherein the flat plates for forming the support column, and the flat plates for the support column and the upper plate or the lower plate are fittable and disassemblable.

Advantageous Effects of Invention

According to one embodiment of the present invention, the buffer cap is formed by fitting the flat plates. Thus, the buffer cap can be disassembled into a plurality of flat plates. After the disassembly of the buffer cap into the plurality of flat plates, the flat plates obtained after the disassembly can be grouped into one or a plurality of sets. Thus, the one or the plurality of sets of the flat plates are not large in size, and thus can easily be conveyed. Further, the buffer cap is stored after being disassembled into the plurality of flat plates. As a result, the buffer cap, which can be stored in a compact space, can be achieved.

DESCRIPTION OF EMBODIMENTS

First Embodiment

Figure 1:
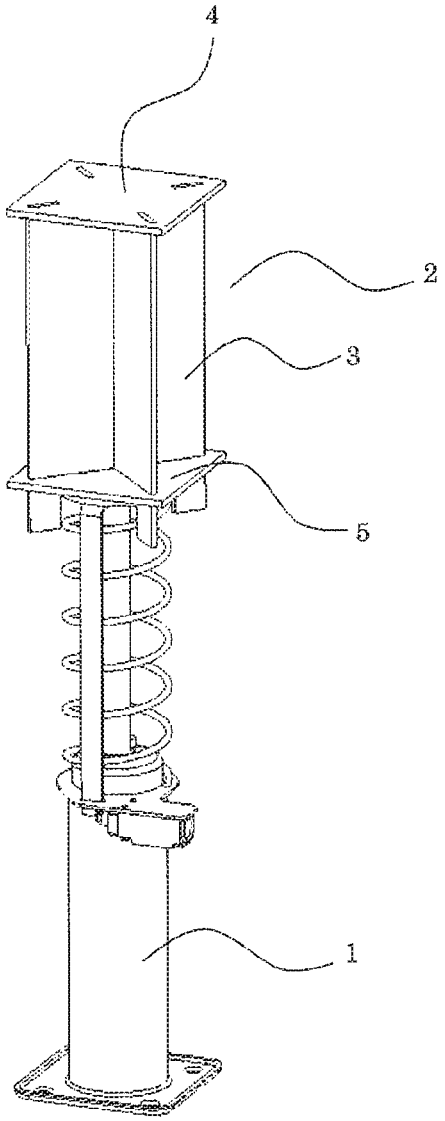
FIG. 1 is a perspective view for illustrating a whole buffer cap for an elevator according to a first embodiment of the present invention.
Figure 2:
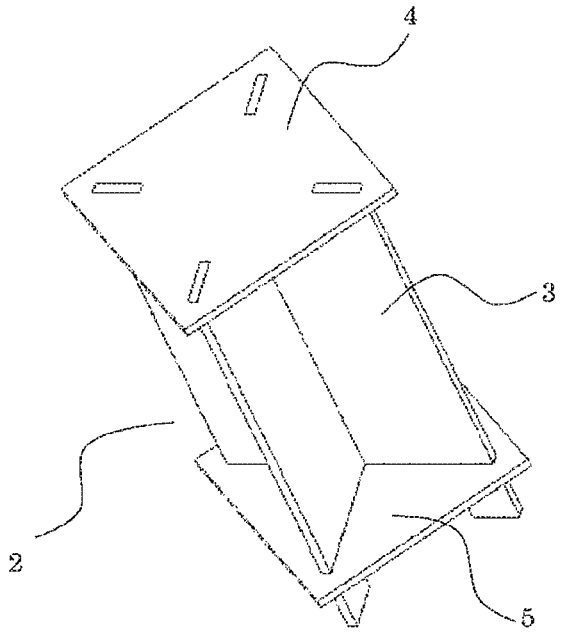
FIG. 2 is a perspective view for illustrating a main part of FIG. 1 according to the first embodiment of the present invention when the buffer cap is an assembled state.
Figure 3:
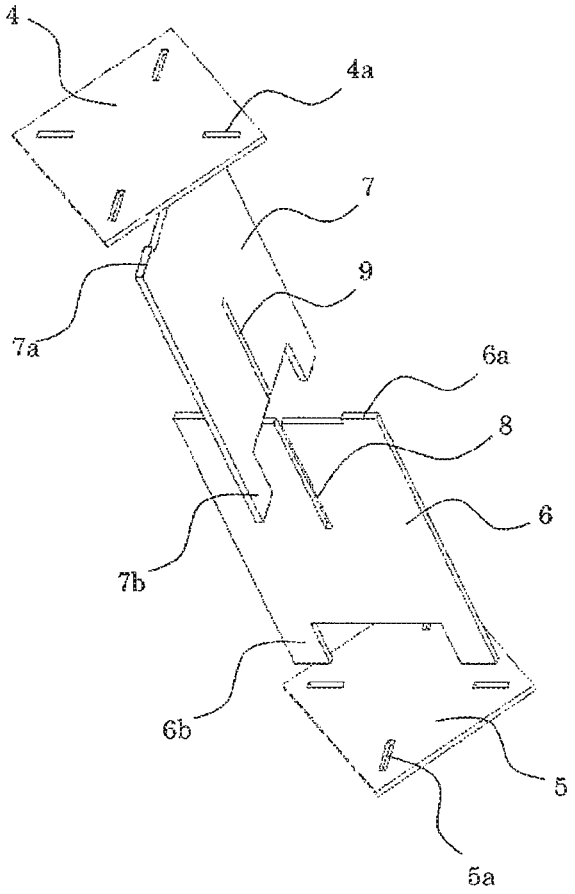
FIG. 3 is a perspective view for illustrating the main part of FIG. 1 according to the first embodiment of the present invention when the buffer cap is in a disassembled state.

FIG. 1 to FIG. 3 are views for illustrating a buffer cap for an elevator according to a first embodiment of the present invention. FIG. 1 is a perspective view of a whole buffer cap, FIG. 2 is a perspective view for illustrating a main part of FIG. 1 when the buffer cap is in an assembled state, and FIG.

3 is a perspective view for illustrating the main part of FIG. 1 when the buffer cap is in a disassembled state.

In FIG. 1 to FIG. 3, a buffer 1 is provided in a pit section of a hoistway for an elevator. As a buffer cap configured to restrict lowering of a counterweight (not shown), a buffer cap 2 is placed on top of the buffer 1 below the counterweight. The buffer cap 2 includes a support column 3, an upper plate 4, and a lower plate 5. The support column 3 has a predetermined height in a vertical direction. The upper plate 4 is provided to an upper end of the support column 3 so as to be opposed to a lower surface of the counterweight. The lower plate 5 is provided to a lower end of the support column 3 so as to be opposed to an upper surface of the buffer 1. The upper plate 4 and the lower plate 5 are supported at a predetermined distance from each other.

The support column 3 includes two flat plates, specifically a flat plate 6 and a flat plate 7, which are provided upright. The flat plate 6 has a groove 8, which is formed by vertically cutting a side surface about halfway through a vertical length thereof from an approximately middle portion of an upper end when viewed from the side surface. The flat plate 7 has a groove 9, which is formed by vertically cutting a side surface about halfway through a vertical length thereof from an approximately middle portion of a lower end when viewed from the side surface. When the support column 3 is in an assembled state, the groove 8 formed on the flat plate 6 and the groove 9 formed on the flat plate 7 cross each other on a cross section. The flat plate 6 and the flat plate 7 are arranged in a cross shape when viewed from above. The support column 3 is formed with the flat plate 6 and the flat plate 7 being fitted to each other. The flat plate 6 and the flat plate 7 are fitted merely at the groove 8 and the groove 9, and thus are separable from each other when not in use.

Two tenons 6*a* and two tenons 6*b* are respectively formed at an upper end and a lower end of the flat plate 6 for forming the support column 3 so as to protrude in the vertical direction. Two tenons 7*a* and two tenons 7*b* are respectively formed at an upper end and a lower end of the flat plate 7 for forming the support column 3 so as to protrude in the vertical direction. Through each of the upper plate 4 and the lower plate 5, four mortises 4*a* are formed in the vicinities of corners of a rectangle along a radial direction from a center when viewed from above. For the buffer cap 2, the tenons 6*a* and 7*a* are fitted into the mortises 4*a* and the tenons 6*b* and 7*b* are fitted into mortises 5*a* to fit the upper plate 4 and the lower plate 5 to the upper end and the lower end of the support column 3, respectively. Specifically, the support column 3 is formed of the flat plate 6 and the flat plate 7 and is formed so as to be vertically interposed between the upper plate 4 and the lower plate 5. Thus, the buffer cap 2 is formed of a total of four flat plates.

Next, an operation of the first embodiment having the configuration described above is described. In FIG. 2 and FIG. 3, when the buffer cap 2 is assembled, first, the flat plate 6 and the flat plate 7 for forming the support column 3 are fitted so as to cross each other with the grooves 8 and 9 being opposed to each other on the cross section, and are arranged in the cross shape when viewed from above. Next, the tenons 6*a* and 7*a* at an upper end of the support column 3 are fitted into the mortises 4*a* of the upper plate 4, whereas the tenons 6*b* and 7*b* at a lower end thereof are fitted into the mortises 5*a* of the lower plate 5. In this manner, the buffer cap 2 is formed of the support column 3, the upper plate 4, and the lower plate 5, and is placed on the top of the buffer 1 to be used as a buffer cap configured to restrict the lowering of the counterweight.

Next, when the buffer cap 2 is disassembled, the buffer cap 2 is disassembled in a reverse procedure to that for assembly. The upper plate 4, which is fitted to the support column 3 through the fitting of the tenons 6*a* and 7*b* into the mortises 4*a*, and the lower plate 5, which is fitted to the support column 3 through the fitting of the tenons 6*b* and 7*b* into the mortises 5*a*, are pulled out in the vertical direction to be disassembled. Further, the plates 6 and 7, which are in the fitted state, are pulled in an upward and downward direction to disassemble the support column 3 into the two flat plates 6 and 7. The flat plate 6, the flat plate 7, the upper plate 4, and the lower plate 5, which are obtained by disassembling the support plate 3, are placed and stored one by one or in a state in which a plurality thereof are stacked, at a predetermined location in the pit.

As described above, according to the first embodiment, the buffer cap 2, which is placed on the upper surface of the buffer 1 provided below the counterweight for an elevator so as to be opposed to the lower surface of the counterweight and is configured to restrict the lowering of the counterweight, includes the support column 3, and the upper plate 4 and the lower plate 5, which are respectively provided to the upper end and the lower end of the support column 3. The support column 3 is formed of the flat plates, and each of the upper plate 4 and the lower plate is formed of the flat plate. The flat plate 6 and the flat plate 7 of the support column 3, and the support column 3 and the upper plate 4 or the lower plate 5 are formed so that the flat plates are fittable or disassemblable. With the configuration described above, the buffer cap 2 can be disassembled into the plurality of flat plates. As a result of the disassembly of the buffer cap 2 into the plurality of flat plates, the flat plates obtained by the disassembly can be grouped into one orapluralityof sets. Thus, the fiatplates, which are grouped into one or the plurality of sets, are not large in size, and thus can easily be conveyed. Further, the buffer cap 2 is stored after being disassembled into the plurality of flat plates. As a result, the buffer cap 2 can be stored in a compact space.

As described above, according to the first embodiment, the support column 3 includes the flat plate 6 having the groove 8 formed by cutting the side surface about halfway through the vertical length thereof from the approximately middle portion of the upper end when viewed from the side surface and the flat plate 7 having the groove 9 formed by cutting the side surface about halfway through the vertical length thereof from the approximately middle portion of the lower end when viewed from the side surface, which are provided so as to cross each other with the grooves 8 and 9 being opposed to each other on the cross section. The tenons 6*a* and 7*a* are formed at the upper end of the support column 3, whereas the tenons 6*b* and 7*b* are formed at the lower end of the support column 3. The mortises 4*a*, into which the tenons 6*a* and 7*a* are to be fitted, are formed through the upper plate 4, whereas the mortises 5*a*, into which the tenons 6*b* and 6*b* are to be fitted, are formed through the lower plate 5. With the configuration described above, the buffer cap 2 can be formed by fitting the total of four flat plates or disassembled. In this manner, the buffer cap 2 can easily be conveyed and can be stored in the compact space. Further, the buffer cap 2 can be formed solely of the total of four flat plates. Hence, manufacturing cost can be minimized.

Second Embodiment

Figure 4:
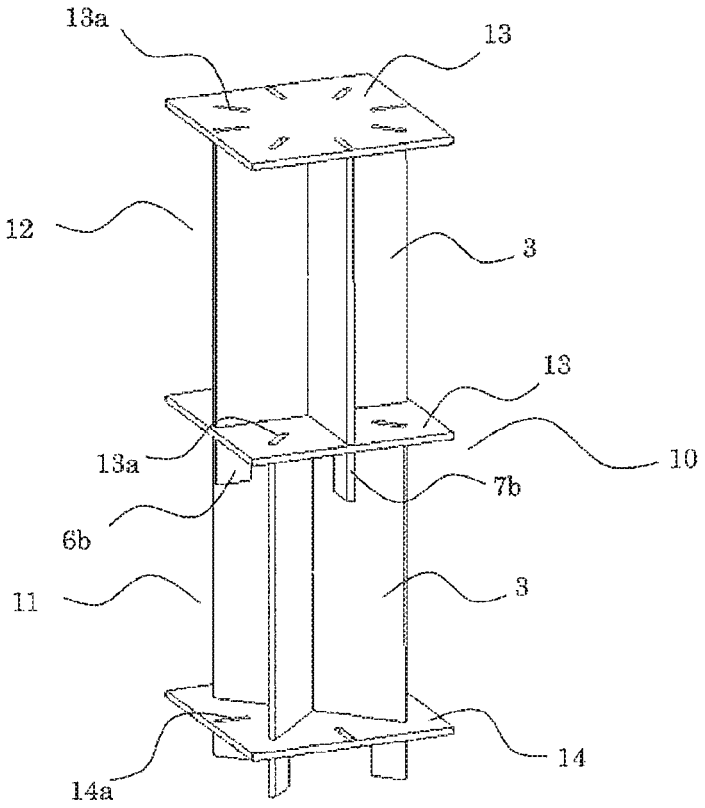
FIG. 4 is a perspective view for illustrating a buffer cap according to a second embodiment of the present invention when the buffer cap is in an assembled state.

FIG. 4 is a perspective view for illustrating a buffer cap 10 according to a second embodiment of the present invention when the buffer cap 10 is in an assembled state. The buffer cap 10 for an elevator according to the second embodiment of the present invention is different in the following configuration. The buffer cap 10 includes a buffer cap 11 and a buffer cap 12, which are arranged so as to be stacked in the vertical direct on. The tenons 6*b* and 7*b* formed at the lower end of the support column 3 of the buffer cap 12 arranged on an upper side and mortises 13*a* formed through an upper plate 13 of the buffer cap 11 arranged on a lower side are fitted to each other to fit the buffer cap 12 arranged on the upper side and the buffer cap 11 arranged on the lower side to each other. Other similar portions are denoted by the same reference symbols, and description thereof is herein omitted.

In FIG. 4, the buffer cap 10 includes the buffer cap 12 arranged so as to be stacked on top of the buffer cap 11. The lower buffer cap 11 has substantially the same structure as that of the buffer cap 2 of the first embodiment. The buffer cap 11 is different from the buffer cap 2 in that the mortises 13*a* are formed through the upper plate 13 and mortises 14*a* are formed through a lower plate 14 of the buffer cap 11. For fitting of the tenons 6*b* and 7*b* formed at the lower end of the support column 3 of the buffer cap 12, four additional mortises are formed. Thus, a total of eight mortises are formed.

The upper buffer cap 12 has substantially the same structure as that of the buffer cap 2 of the first embodiment. The buffer cap 12 is different from the buffer cap 2 in that the upper plate 13 of the buffer cap 11 also serves as a lower plate of the buffer cap 12 so as to omit the lower plate of the buffer cap 12.

Now, an operation of the second embodiment having the configuration described above is described. In FIG. 4, first, after the buffer cap 11 is assembled in the same procedure as that in the first embodiment, the buffer cap 12 stacked on the top thereof to fit the two buffer caps to each other. A procedure of assembly of the buffer cap 12 is the same as that of the buffer cap 11. The tenons 6*b* and 7*b* of the support column 3 are fitted into the mortises 13*a* of the upper plate 13 of the assembled buffer cap 11 from above, and the mortises 13*a* of the upper plate 13 are fitted into the tenons 6*a* and 7*a* of the support column 3 of the buffer cap 12 from above. Next, when the buffer cap 10 is disassembled, the buffer cap 10 is disassembled in a reverse procedure to that for assembly. Specifically, after the buffer cap 12 is disassembled in the same procedure as that in the first embodiment, the buffer cap 11 is disassembled.

As described above, according to the second embodiment, the lower buffer cap 11 and the upper buffer cap 12 are arranged so as to be stacked in the vertical direction. The tenons 6*a* and 7*b* formed at the lower end of the support column 3 of the buffer cap 12 arranged on the upper side and the mortises 13*a* formed through the upper plate 13 of the buffer cap 11 arranged on the lower side are fitted to each other so as to fit the buffer cap 12 arranged on the upper side and the buffer cap 11 arranged on the lower side to each other. When a larger height of the buffer cap is required in accordance with conditions of use of the elevator, the support column 3 can be extended in length. Merely with the extension of the length of the support column 3, however, buckling is liable to occur due to a load applied from above. Therefore, strength of the members of the support column 3 is required to be increased. Accordingly, the two buffer caps, specifically, the buffer cap 11 and the buffer cap 12 are used in a stacked manner. As a result, the strength of the buffer cap 10 can be increased without increasing the strength of the flat plate 6 for forming the support column 3. Further, the lower buffer cap 11 can be used alone as a single body. Therefore, a height of the buffer cap 10 can be selectively adjusted by using the buffer cap 11 alone as the single body or additionally using the buffer cap 12 stacked thereon. Further, the support column 3 of the first embodiment can be directly used for the buffer cap 10. Thus, manufacturing cost of the buffer cap 10 can be minimized.

Third Embodiment

Figure 5:
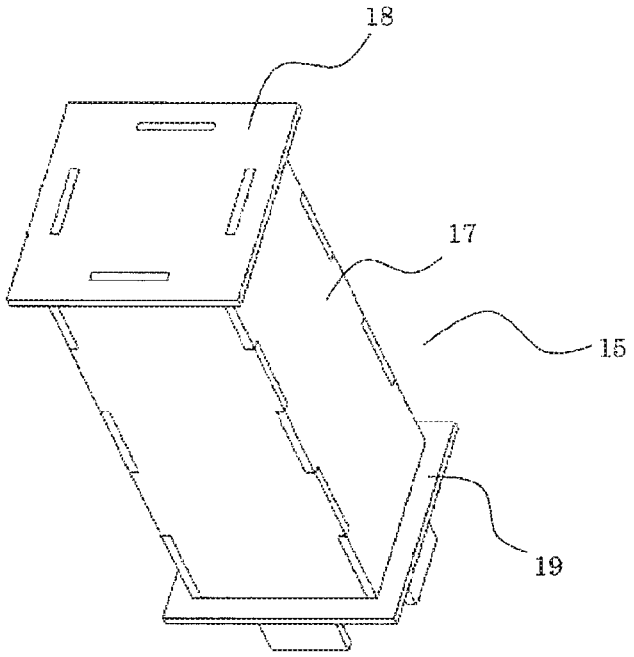
FIG. 5 is a perspective view for illustrating a buffer cap according to a third embodiment of the present invention when the buffer cap is in an assembled state.
Figure 6:
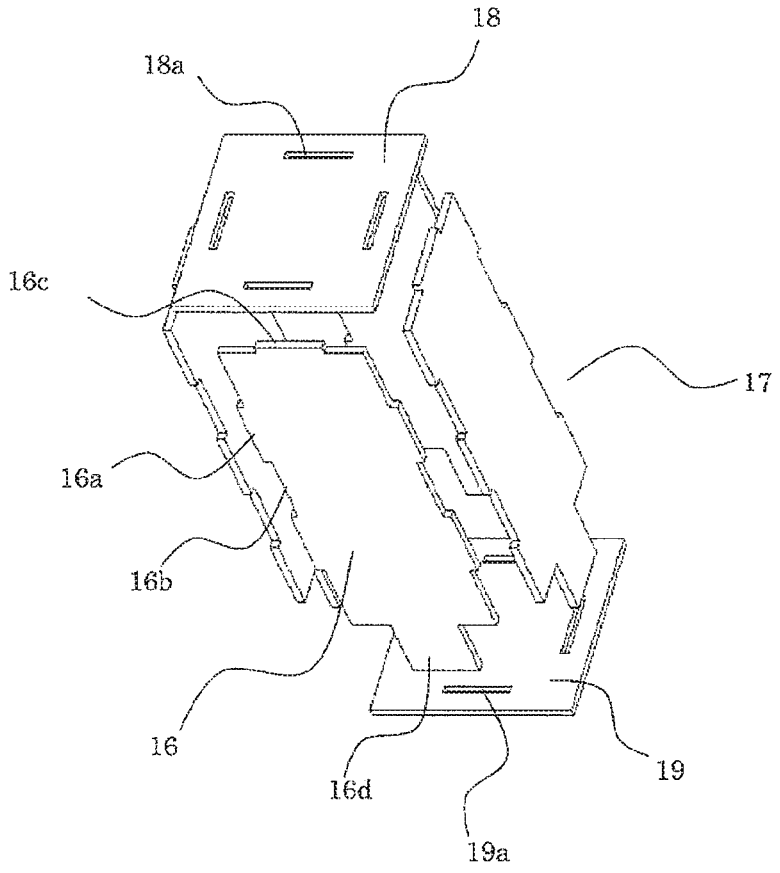
FIG. 6 is a perspective view for illustrating the buffer cap according to the third embodiment of the present invention when the buffer cap is in a disassembled state.

FIG. 5 and FIG. 6 are perspective views for illustrating a buffer cap 15 according to a third embodiment of the present invention in an assembled state and a disassembled state, respectively. A buffer cap 15 for an elevator according to the third embodiment of the present invention is different in the following configuration. A support column 17 of the buffer cap 15 has a prismatic shape. Each of flat plates 16, each forming a side surface of the prismatic shape, has tenons 16*a* and tenon grooves 16*b*, which are formed alternately. The tenons 16*a* are formed on both sides of a sides surface portion in the vertical direction so as to protrude in a horizontal direction. The tenon grooves 16*b* are configured to be fitted to the tenons 16*a*. The tenons 16*a* and the tenon grooves 16*b*, which are arranged adjacent to each other when viewed from above, are fitted to each other. Other similar portions are denoted by the same reference symbols, and description thereof is herein omitted.

In FIG. 5 and FIG. 6, the support column 17 includes the four flat plates 16, which are arranged upright and in a rectangular shape when viewed from above and are fitted to each other in a longitudinal direction. An upper plate 18 is provided to an upper end of the support column 17 so as to be opposed to the lower surface of the counterweight, whereas a lower plate 19 is provided to a lower end of the support column 17 so as to be opposed to the upper surface of the buffer 1. The upper plate 18 and the lower plate 19 are supported at a predetermined distance therebetween.

The tenons 16*a*, each being a first tenon, are formed at both vertical ends of one flat plate 6 of the support column 17 so as to protrude in the horizontal direction. The tenon grooves 16*b* to be fitted to the tenons 16*a* are formed alternately with the tenons 16*a*. Specifically, the four flat plates 16 are arranged so as to be adjacent to each other at corners when viewed from above. The tenon 16*a* and the tenon groove 16*b*, which are adjacent to each other at the corner, are fitted to each other to form a square prismatic shape with the side surfaces of the support column 17. Four mortises 18*a* are formed through the upper plate 18 and four mortises 19*a* are formed through the lower plate 19 so that each of the mortises is formed in the vicinity (on an inner side) of each side of the rectangle along a direction of each side when viewed from above. A tenon 16*c* and a tenon 16*d*, each being a second tenon, are formed at an upper end and a lower end of the support column 17, respectively. The tenons 16*c* and 16*d* and the mortises 18*a* and 19*a* to be fitted thereto are fitted to each other to fit the upper plate 18 and the lower plate 19 to the upper end and the lower end of the support column 17, respectively. Specifically, in the buffer cap 15, the support column 17 is formed of the four plates 6 and is formed so as to be vertically interposed between the upper plate 18 and the lower plate 19. Thus, the buffer cap 15 is formed of a total of six flat plates.

Next, an operation of the third embodiment having the configuration described above is described. In FIG. 5 and FIG. 6, when the buffer cap 15 is assembled, the four flat plates 16 for forming the support column 17 are first arranged in the rectangular shape when viewed from above so as to be adjacent to each other at the corners. Then, the tenons 16*a* and the tenon grooves 16*b* formed at both vertical ends are fitted to each other. Next, the tenons 16*c* at the upper end of the support column 17 are fitted into the mortises 18*a* of the upper plate 16 to fit the tenons 16*d* at the lower end into the mortises 19*a* of the lower plate 5, respectively. In this manner, the buffer cap 15 is formed of the support column 17, the upper plate 18, and the lower plate 19, and is placed on the top of the buffer 1 to be used as a buffer cap configured to restrict the lowering of the counterweight. Next, when the buffer cap 15 is disassembled, the buffer cap 15 is disassembled in a reverse procedure to that for assembly.

As described above, according to the third embodiment, the support column 17 has the prismatic shape. Each of the flat plates 16 for forming the side surfaces of the support column 17 has the tenons 16*a* formed on both sides of the side surface portion in the vertical direction so as to protrude in the horizontal direction and the tenon grooves 16*b* to be fitted to the tenons 16*a*, which are formed alternately. The tenons 16*a* and the tenon grooves 16*b*, which are arranged adjacent to each other when viewed from above, are fitted to each other. Each of the flat plates 16 for forming the side surfaces of the support column 17 has the tenon 16*c* formed at the upper end and the tenon 16*d* formed at the lower end. The mortises 18*a* and the mortise 19*a* to be fitted to the tenons are formed in the upper plate 18 and the lower plate 19, respectively. With the configuration described above, all the parts for forming the buffer cap 15 can be disassembled into the total of six flat plates. Accordingly, the buffer cap 15 can be formed solely of the six flat plates. Further, when the support column 17 is formed of the flat plates 16 having the same strength as that in the first embodiment, the strength against a load applied from above can be increased as compared with that of the buffer cap 2 of the first embodiment.

Fourth Embodiment

Figure 7:
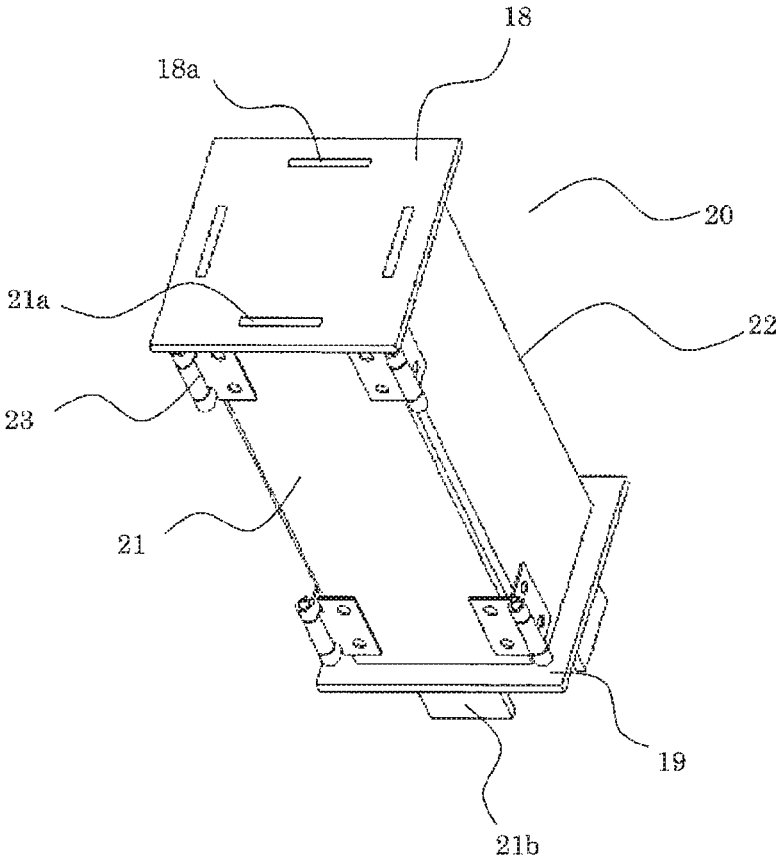
FIG. 7 is a perspective view for illustrating a buffer cap according to a fourth embodiment of the present invention when the buffer cap is in an assembled state.

FIG. 7 is a perspective view for illustrating a buffer cap 20 according to a fourth embodiment of the present invention in an assembled state. The buffer cap 20 for an elevator according to the fourth embodiment of the present invention is different in the following configuration. A support column 22 of the buffer cap 20 has a prismatic shape. For each of flat plates 21 for forming the side surfaces of the support column 22, hinges 23 are provided at an upper position and a lower position on each of both sides of a side surface portion in the vertical direction. The flat plates 21 are coupled to each other with the hinges 23 except at least on one side. Other similar portions are denoted by the same reference symbols, and description thereof is herein omitted.

in FIG. 7, the buffer cap 20 has substantially the same structure as that of the buffer cap 15 of the third embodiment. A difference from the buffer cap 15 lies in that the hinges 23 are provided at both of an upper end and a lower end of the support column 22 in the vertical direction in place of the tenons and the tenon grooves. When viewed from above, the four flat plates 21 are arranged so as to be adjacent to each other at corners. Three of the corners, which are adjacent to each other, are coupled to each other with the hinges 23. One adjacent corner is brought into contact therewith or brought closer thereto to thereby form a quadrangular prismatic shape with the side surfaces of the support column 22.

In this case, the hinges 23 are not provided at one of the four corners adjacent to each other so as to facilitate disassembly or the assembly. Specifically, the four flat plates 21, each having the same orientation, are arranged side by side in one direction, and the side surface portions adjacent to each other are coupled with the hinges 23 provided at the three corners. When the two flat plates 21 without the hinges 23 among the thus coupled four flat plates 21 are arranged so that side surface portions thereof are adjacent to each other, the side surfaces of the support column 22 are formed. The upper plate 18 and the lower plate 19 are fitted to an upper end and a lower end of the support column 22, as in the third embodiment.

Next, an operation of the fourth embodiment having the configuration described above is described. In FIG. 7, when the buffer cap 20 is assembled, the four flat plates 21 for forming the side surfaces of the support column 22 are first turned through intermediation of the hinges 23 so that the side surface portions of the two flat plates 21 without the hinges 23 are adjacent to each other. In this manner, the four flat plates 21 are arranged in a rectangular shape when viewed from above. Next, tenons 21*a* at the upper end of the support column 22 are fitted into the mortises 18*a* of the upper plate 18, whereas tenons 21*b* at the lower end thereof are fitted into the mortises 19*a* of the lower plate 5.

In this manner, the buffer cap 20 is formed of the support column 22, the upper plate 18, and the lower plate 19, and is placed on the top of the buffer 1 to be used as a buffer cap configured to restrict the lowering of the counterweight. Next, when the buffer cap 20 is disassembled, the buffer cap 20 is disassembled in a reverse procedure to that for assembly.

As described above, according to the fourth embodiment, the support column 22 has the prismatic shape. The hinges 23 are provided on both sides of the side surface portion in the vertical direction, for each of the flat plates 21 for forming the side surfaces of the support column 22. The flat plates 21 are coupled to each other except at least at one corner. The tenon 21*a* and the tenon 21*b* are formed at the upper end and the lower end of each of the flat plates 21 for forming the side surfaces of the support column 22, respectively. The mortises 18*a* and the mortises 19*a* to be fitted to the tenons 21*a* and the tenons 21*b* are formed through the upper plate 18 and the lower plate 19, respectively. As a result, not only functions and effects equivalent to those of the third embodiment are obtained, but also time and efforts for fitting the flat plates 21 for forming the support column 22 to each other at the time of disassembly or assembly can be significantly reduced. Further, the buffer cap 20 can be disassembled into the total of six flat plates as all the parts for forming the buffer cap 20. With the structure described above, the buffer cap 20 can be formed solely of the six flat plates.

In the first embodiment, the support column 3 is formed of two flat plates, specifically, the flat plate 6 and the flat plate 7. However, the support column 3 may be formed of three or more plates. With the increase in number of flat plates, the number of flat plates to be stored is slightly increased. However, as in the first embodiment, the buffer cap 2 can be disassembled into the plurality of flat plates. At the same time, the strength against the load exerted from above can be increased.

Further, in the second embodiment, the upper plate 13 of the buffer cap 11 also serves as the lower plate of the buffer cap 12 so that the lower plate of the buffer cap 12 is omitted. However, the lower plate is not required to be omitted. Specifically, the buffer cap 12 having the same structure as that of the buffer cap 11 may be stacked on the lower buffer cap 11. As a result, a storage space therefor is slightly increased because of addition of the flat plate for forming the lower plate. However, when the buffer cap is required to have a large height as in the second embodiment, the strength of the buffer cap 10 can be increased with the stacking of the two buffer caps.

Further, in the second embodiment, the two buffer caps, specifically, the buffer cap 11 and the buffer cap 12 are stacked. However, three or more buffer caps may be provided in a stacked manner in accordance with conditions of use of the elevator.

In the third embodiment, the support column 17 is formed to have the quadrangular prismatic shape. However, the support column 17 may be formed to have a polygonal prismatic shape. Specifically, when the support column 17 is formed to have, for example, a triangular prismatic shape, the number of flat plates for forming the support column 17 can be reduced. Further, when the support column 17 is formed to have a pentagonal prismatic shape or a polygonal prismatic shape having five or more sides, a storage space is slightly increased because of increase in number of flat plates for forming the support column 17. However, the buffer cap 15 can be disassembled into the plurality of flat plates as all the parts for forming the buffer cap 15, and the strength can be increased, as in the third embodiment.

In the fourth embodiment, the hinges 23 are provided at two positions, specifically, the upper position and the lower position. However, the hinge 23 may be provided only at one position in the middle. Specifically, the four flat plates 21 for forming the support column 22, each having the same orientation, are arranged side by side in one direction, and the side surface portions are only required to be coupled to each other with the hinges 23 provided at three positions.

REFERENCE SIGNS LIST

1 buffer, 2, 10, 11, 12, 15, 20 buffer cap, 8, 9 groove, 17, 22 support column, 4, 13, 18 upper plate, 5, 14, 19 lower plate, 6, 7, 16, 21 flat plate, 6*a*, 6*b*, 7*a*, 7*b*, 16*a*, 16*c*, 16*d*, 21*a*, 21*b* tenon, 4*a*, 5*a*, 13*a*, 14*a*, 18*a*, 19*a* mortise, 16*b* tenon groove, 23 hinge

INDUSTRIAL APPLICABILITY

The present invention relates to a buffer cap to be placed on top of a buffer to ensure a safety space for a worker at time of maintenance inspection for an elevator.

The invention claimed is:

1. A buffer cap to be placed on an upper surface of a buffer provided below a counterweight for an elevator so as to be opposed to a lower surface of the counterweight, which is configured to restrict lowering of the counterweight, the buffer cap comprising:

a support column;

an upper plate provided to an upper end of the support column; and a lower plate provided to a lower end of the support column, wherein the support column is formed of flat plates, and each of the upper plate and the lower plate is formed of a flat plate, wherein the flat plates for forming the support column, and the flat plates for the support column and the upper plate or the lower plate are fittable and disassemblable from each other, wherein the support column is formed of a flat plate having a groove cut out from an upper end to have a predetermined length in a vertical direction and a flat plate having a groove cut out from a lower end to have a predetermined length in the vertical direction, which are arranged so as to cross each other with the grooves being opposed to each other on a cross section, and wherein tenons are formed at the upper end and the lower end of the support column, whereas mortises to be fitted to the tenons are formed through the upper plate and the lower plate, respectively.

2. The buffer cap according to claim 1, wherein the buffer cap comprises an upper buffer cap and a lower buffer cap, wherein the buffer caps are arranged so as to be stacked in the vertical direction, and wherein the tenon formed at the lower end of the support column of the upper buffer cap and the mortise formed through any one or both of the lower plate of the upper buffer cap and the upper plate of the lower buffer cap are fitted to each other in order to assemble the upper cap and the lower buffer cap together.

* * * * *